United States Patent [19]

Hahs

[11] 4,118,142

[45] Oct. 3, 1978

[54] DUAL-PUMP COUPLING

[76] Inventor: William A. Hahs, Hwy. 61, South, Sikeston, Mo. 63801

[21] Appl. No.: 824,824

[22] Filed: Aug. 15, 1977

[51] Int. Cl.[2] ..... F04D 25/16; F01D 13/00

[52] U.S. Cl. ..... 415/69; 417/244; 417/359

[58] Field of Search ..... 417/359, 361, 244, 247; 415/69, 140; 60/236

[56] References Cited

U.S. PATENT DOCUMENTS

| | | | |
|---|---|---|---|
| 1,656,281 | 1/1928 | Layne | 417/359 |
| 2,434,979 | 1/1948 | Bergh | 417/359 |
| 2,620,735 | 12/1952 | Baez | 415/69 |
| 2,778,614 | 1/1957 | Koch | 415/69 X |
| 2,827,855 | 3/1958 | Rankin | 417/359 X |

*Primary Examiner*—Carlton R. Croyle
*Assistant Examiner*—R. E. Gluck
*Attorney, Agent, or Firm*—Edward C. Threedy

[57] ABSTRACT

An adjustable coupling for operatively connecting the shaft of a low-pressure deep well pump to the shaft of a high-pressure booster pump whereby both pumps may be driven by a common prime mover.

8 Claims, 3 Drawing Figures

DUAL-PUMP COUPLING

SUMMARY OF THE INVENTION

This invention relates to a deep well pump in which the water is pumped to the surface through one type of pump, such as a propeller and auger, and into the intake side of a larger diameter centrifugal or booster pump which is not limited to the size of the well, thereby making it possible for the coupled pumps to produce much higher liquid pressure at a lower driven speed.

With the use of the present invention, the volume output of a well is materially increased irrespective of the size of the well casing. As the invention is adaptable to operate with existing deep well propeller pumps encased in wells of varying diameters, it obviates the necessity of increasing well diameters to obtain increased volume.

It is also an object of this invention to provide a means of coupling a drive shaft of a low-pressure lift pump located and locked in place within the well casing, in the manner shown and described in U.S. Pat. Nos. 3,033,615 and 3,485,181, to the drive shaft of an external high-pressure pump.

The invention provides a coupling between the separate drive shafts of a low-pressure lift pump and a high-pressure booster pump in such a manner that the location of the impeller of the booster pump within its volute casing may be set independently from the propellers of the low-pressure lift pump located within the well casing so that both shafts can be driven by a common drive source so as to cooperate to produce a high pressure at a lower speed.

GENERAL DESCRIPTION

The objects of the invention will be best accomplished by reference to the accompanying drawings showing the preferred embodiment, and in which.

Figure 1:
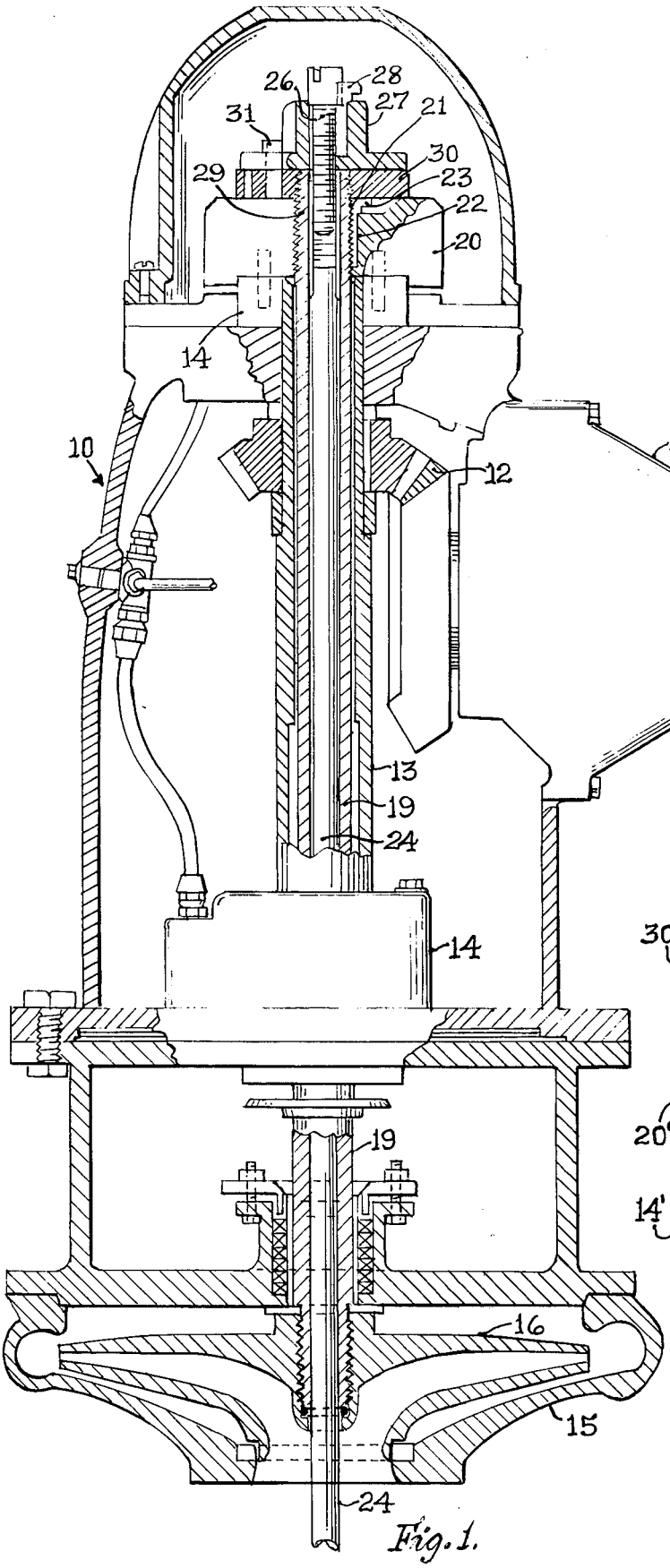
FIG. 1 is a partial sectional detail view of the drive coupling of this invention.

FIG. 1 discloses a housing 10 for a motor 11 including a wedge gear drive train 12 associated with the booster pump of this invention. The wedge gear drive train 12 is operatively connected to and adapted to rotate a hollow drive shaft 13 extending vertically within the housing 10 between a pair of bearing units 14.

The housing 10 also provides at the bottom thereof a volute casing 15 for a booster pump impeller 16, which casing is adapted to be placed upon the upper exposed top 17 (FIG. 3) of a well casing 18. The booster pump impeller 16 is threadably connected to the end of a hollow booster pump shaft 19. The hollow booster pump shaft 19, as shown, extends axially to and is positioned within the hollow drive shaft 13, with its end projecting beyond the bearing units 14.

The upper end of the hollow drive shaft 13 carries a drive clutch assembly 20 which is of any standard construction and which is well-known in the art and, as such, makes up no part of the present invention.

The hollow drive shaft 13 through its drive clutch assembly 20 is fixedly attached to the hollow booster pump shaft 19. To connect the drive clutch assembly 20 of the hollow drive shaft 13 to the hollow booster pump shaft 19, the hollow booster pump shaft 19 has formed in its top end a keyway 21 which corresponds to a keyway 22 formed in the drive clutch assembly 20, which keyways are adapted to receive a gib key 23, which in turn connects the two hollow drive shafts 13 and 19 together.

Figure 3:
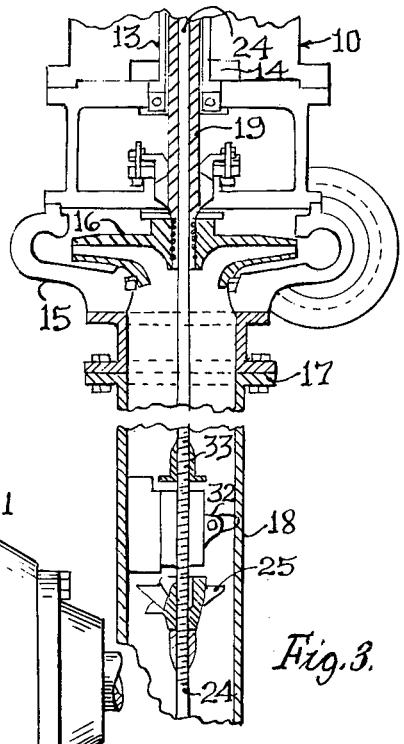
FIG. 3 is a fragmentary partial detailed sectional view of the arrangement of the deep well pump and the booster pump.

Referring to FIG. 3, there is partially illustrated the locking means for positioning the deep well propeller drive shaft 24, as well as a series of liquid lifting propellers 25, within the well casing 18 in the manner shown and described in U.S. Pat. Nos. 3,033,615 and 3,485,181.

It is the purpose of this invention to provide a coupling between the deep well drive shaft 24 and the hollow booster pump shaft 19, such that both of these shafts 19 and 24 may be operated through the single prime mover or motor 11, while longitudinally adjustable one to the other.

Again referring to FIG. 3, it is shown that the drive shaft 24 continues upwardly and projects through the volute casing 15 and is journalled within the hollow booster pump shaft 19. The upper end of the drive shaft 24 extends not only through the hollow booster pump shaft 19 but also the hollow drive shaft 13 and beyond the drive clutch assembly 20 thereof. The exposed end 26 of the drive shaft 24 is threaded so as to receive an adjusting and drive nut 27. Through the use of a gib key 28 positioned in corresponding keyways formed in the free end 26 of the drive shaft 24 and the adjusting and drive nut 27, the drive shaft 24 is connected to the nut 27.

It should also be noted that the upper exposed end 29 of the hollow booster pump shaft 19 is threaded so as to receive thereon the booster shaft adjusting nut 30.

To connect the propeller pump adjusting and drive nut 27 and the booster shaft adjusting nut 30 to the clutch assembly 20, there are provided a number of shoulder drive screws 31, which project through the nuts 27 and 30 and thread into the clutch assembly 20.

It is desirable that there be adjustability through the axial length of the hollow booster pump shaft 19 as well as the deep well propeller drive shaft 24, so that their respective impellers 16 and propellers 25 may be correctly positioned relative to each other and to their corresponding structural components.

After the deep well propeller drive shaft 24 has been located in the well casing 18 by the locking assemblies 32 in the manner set forth in the afore-mentioned patents, it is desirable that the striker 33 as well as the propellers 25 be spaced from the locking assemblies 32, so as to not interfere with the rotation and operation of such parts.

It is also desirable to correctly position the impeller 16 within the volute casing 15. The latter adjustment of the impeller 16 with respect to its casing 15 is accomplished through the attachment of the adjusting nut 30 threaded upon the threaded end 29 of the hollow booster pump shaft 19. Through the threadable connection between the nut 30 and the shaft 19, the same may be moved axially within the hollow drive shaft 13 so as to correctly position the impeller 16 within the volute casing 15 independently of movement of any other components of the dual-pump coupling.

The propeller drive shaft 24 may independently be adjusted axially of both the hollow drive shaft 13 and the hollow booster pump shaft 19 by having the adjusting and drive nut 27 threaded upon the threaded end 26 of such shaft 24. The longitudinal adjusting of the shaft 24 will correctly position the propellers 25 and the striker 33 with respect to the locking assemblies 32 within the well casing 18.

From the foregoing, it is readily apparent that the proper spacings of the propellers 25 within the well casing 18 are accomplished through the adjusting and drive nut 27 and that the impeller 16 is likewise independently adjustably positioned within the volute casing 15, with the hollow drive shaft 13 connected to the hollow booster pump shaft 19 and with such hollow booster pump shaft 19 in turn connected to the propeller drive shaft 24 such that they are all caused to rotate through the common prime mover motor 11 and gear train 12.

Figure 2:
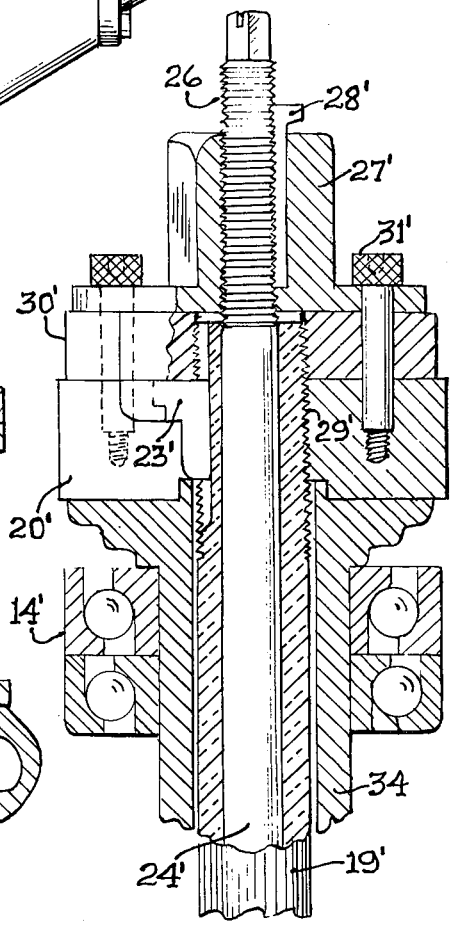
FIG. 2 is a fragmentary detailed sectional view showing a modified drive coupling.

In FIG. 2, there is shown a modified version of the dual-pump coupling wherein a hollow drive shaft 34 may be part of a vertical hollow shaft of an electrical motor. As such the hollow drive shaft 34 is connected to the corresponding structure already identified and indicated by corresponding primed reference numerals. For example, the hollow booster pump shaft of the modified form is shown at 19', and the propeller drive shaft is indicated at 24'.

From the foregoing, it is readily apparent that I have provided a means for operatively coupling together two different types of pumps which can be operated in unison while being independently adjustable, so that they perform with the highest efficiency to produce more liquid pressure at a lower driven speed.

While I have illustrated and described the preferred form of construction for carrying my invention into effect, this is capable of variation and modification without departing from the spirit of the invention. I, therefore, do not wish to be limited to the precise details of construction set forth, but desire to avail myself of such variations and modifications as come within the scope of the appended claims.

Having thus described my invention, what I claim as new and desire to protect by Letters Patent is:

1. An adjustable drive coupling between a deep well propeller pump and a booster pump assembly, comprising (a) a housing adapted to be carried on the exposed end of a well casing, (b) a booster pump within said housing providing a hollow driven shaft having an impeller thereon within a volute casing having open communication with the well casing, (c) a driving power source assembly within said housing, (d) means connecting said driving power source to said hollow driven shaft for operating said booster pump, (e) means for vertically adjusting said hollow drive shaft and said impeller of said booster pump within said housing and said volute casing relative to said driving power source assembly, (f) a propeller pump shaft extending coaxially of said hollow drive shaft of said booster pump and projecting from said housing into the well casing, (g) means connecting said propeller pump shaft to said hollow driven shaft of said booster pump, whereby said propeller pump is simultaneously operated therewith by said driving power source assembly, and (h) means for independently vertically adjusting said propeller pump shaft coaxially of said hollow drive shaft of said booster pump.

2. An adjustable drive coupling as defined by claim 1, wherein said driving power source assembly includes a hollow driven shaft within said housing extending coaxially of the well casing and in which is journalled said hollow drive shaft of said booster pump and said propeller pump shaft.

3. An adjustable drive coupling as defined by claim 1, wherein said means for vertically adjusting said hollow drive shaft and said impeller within said housing relative to said driving power source assembly, comprises an adjusting nut threadable upon an exposed end of said hollow drive shaft, and bearing upon said driving power source assembly so as to longitudinally position said hollow drive shaft relative thereto and said impeller within said volute casing.

4. An adjustable drive coupling as defined by claim 3, wherein said driving power source assembly includes a hollow driven shaft within said housing extending coaxially of the well casing and in which is journalled said hollow drive shaft of said booster pump and said propeller pump shaft.

5. An adjustable drive coupling as defined by claim 1, wherein said means for independently vertically adjusting said propeller pump shaft comprises an adjustable nut threadable upon an exposed end of said propeller pump shaft and adapted to bear upon said means for vertically adjusting said hollow drive shaft so as to longitudinally position said propeller pump shaft relative to said hollow drive shaft and said driving power source assembly.

6. An adjustable drive coupling as defined by claim 5, wherein said driving power source assembly includes a hollow driven shaft within said housing extending coaxially of the well casing and in which is journalled said hollow drive shaft of said booster pump and said propeller pump shaft.

7. An adjustable drive coupling as defined by claim 3, wherein said means for independently vertically adjusting said propeller pump shaft comprises an adjustable nut threadable upon an exposed end of said propeller pump shaft and adapted to bear upon said adjusting nut on said hollow drive shaft so as to longitudinally position said propeller pump shaft relative to said hollow drive shaft and said driving power source assembly.

8. An adjustable drive coupling as defined by claim 7, wherein said driving power source assembly includes a hollow driven shaft within said housing extending coaxially of the well casing and in which is journalled said hollow drive shaft of said booster pump and said propeller pump shaft.

* * * * *